US007823632B2

(12) United States Patent
McAfee et al.

(10) Patent No.: US 7,823,632 B2
(45) **Date of Patent: *Nov. 2, 2010**

(54) METHOD AND APPARATUS FOR PROGRAMMABLE ROBOTIC ROTARY MILL CUTTING OF MULTIPLE NESTED TUBULARS

(75) Inventors: Wesley Mark McAfee, Montgomery, TX (US); Mark Franklin Alley, Nashville, TN (US)

(73) Assignee: Completion Technologies, Inc., Conroe, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/540,924

(22) Filed: Aug. 13, 2009

(65) Prior Publication Data

US 2010/0038080 A1 Feb. 18, 2010

Related U.S. Application Data

(63) Continuation-in-part of application No. 12/484,211, filed on Jun. 14, 2009.

(60) Provisional application No. 61/131,874, filed on Jun. 14, 2008.

(51) Int. Cl.
*E21B 43/11* (2006.01)
*B23B 41/00* (2006.01)

(52) U.S. Cl. ..... 166/55.7; 175/284; 82/1.2; 82/1.11; 407/53; 409/201

(58) Field of Classification Search ..... 166/55, 166/55.6, 55.7; 175/292, 284; 409/143, 409/201; 82/70.2, 71, 72, 75, 76, 1.2, 1.4, 82/1.5, 1.11; 407/53, 119, 30, 36–39
See application file for complete search history.

(56) References Cited

U.S. PATENT DOCUMENTS

| | | | | | |
|---|---|---|---|---|---|
| 2,216,963 | A | * | 10/1940 | Sinclair | 166/55.3 |
| 2,709,490 | A | * | 5/1955 | Trimble | 166/55.8 |
| 3,195,636 | A | * | 7/1965 | Cordary et al. | 166/55.8 |
| 3,331,439 | A | * | 7/1967 | Sanford | 166/55.8 |
| 4,368,786 | A | * | 1/1983 | Cousins | 175/78 |
| 4,479,541 | A | * | 10/1984 | Wang | 166/268 |

(Continued)

FOREIGN PATENT DOCUMENTS

JP 52036391 A * 3/1977

(Continued)

*Primary Examiner*—David J Bagnell
*Assistant Examiner*—Catherine Loikith
(74) *Attorney, Agent, or Firm*—Hulsey, P.C.; William N. Hulsey, III; Loren T. Smith

(57) ABSTRACT

A methodology and apparatus for cutting shape(s) or profile(s) through well tubular(s), or for completely circumferentially severing through multiple tubulars, including all tubing, pipe, casing, liners, cement, other material encountered in tubular annuli. This rigless apparatus utilizes a computer-controlled, downhole robotic three-axis rotary mill to effectively generate a shape(s) or profile(s) through, or to completely sever in a 360 degree horizontal plane wells with multiple, nested strings of tubulars whether the tubulars are concentrically aligned or eccentrically aligned. This is useful for well abandonment and decommissioning where complete severance is necessitated and explosives are prohibited, or in situations requiring a precise window or other shape to be cut through a single tubular or plurality of tubulars.

63 Claims, 5 Drawing Sheets

U.S. PATENT DOCUMENTS

| | | | | |
|---|---|---|---|---|
| 4,809,775 | A * | 3/1989 | Fortin | 166/55.7 |
| 4,887,668 | A * | 12/1989 | Lynde et al. | 166/55.8 |
| RE33,660 | E * | 8/1991 | Jelsma | 175/107 |
| 5,183,111 | A * | 2/1993 | Schellstede | 166/298 |
| 5,197,783 | A * | 3/1993 | Theimer et al. | 299/17 |
| 5,368,423 | A | 11/1994 | Hanna | |
| 5,810,079 | A | 9/1998 | Lynde et al. | |
| 5,857,530 | A * | 1/1999 | Gronseth | 175/45 |
| 6,595,301 | B1 * | 7/2003 | Diamond et al. | 175/57 |
| 6,821,063 | B2 | 11/2004 | Debat et al. | |
| 6,868,901 | B2 | 3/2005 | Mason et al. | |
| 6,889,781 | B2 * | 5/2005 | Mazorow | 175/77 |
| 7,370,710 | B2 | 5/2008 | Trueman et al. | |
| 7,478,982 | B2 * | 1/2009 | Fuhst et al. | 166/55.7 |
| 7,527,092 | B2 * | 5/2009 | McAfee | 166/55.7 |
| 7,537,055 | B2 * | 5/2009 | Head et al. | 166/298 |
| 7,562,700 | B2 * | 7/2009 | Lewis et al. | 166/55.7 |
| 7,575,056 | B2 | 8/2009 | Fuhst et al. | |
| 2002/0020562 | A1 | 2/2002 | Baird | |
| 2002/0150436 | A1 | 10/2002 | Mason et al. | |
| 2003/0098152 | A1 | 5/2003 | Kennedy et al. | |
| 2005/0067166 | A1 * | 3/2005 | Trueman et al. | 166/313 |
| 2005/0133224 | A1 * | 6/2005 | Ruttley | 166/298 |
| 2005/0205305 | A1 * | 9/2005 | Stout et al. | 175/292 |
| 2005/0247451 | A1 | 11/2005 | Hunt et al. | |
| 2006/0137877 | A1 | 6/2006 | Watson et al. | |
| 2008/0236893 | A1 | 10/2008 | Peter | |

FOREIGN PATENT DOCUMENTS

| | | | |
|---|---|---|---|
| JP | 52071789 | A * | 6/1977 |

* cited by examiner

METHOD AND APPARATUS FOR PROGRAMMABLE ROBOTIC ROTARY MILL CUTTING OF MULTIPLE NESTED TUBULARS

REFERENCE TO RELATED APPLICATION

This application is a continuation-in-part of application Ser. No. 12/484,211, filed Jun. 14, 2009, entitled "Methodology and apparatus for programmable robotic rotary mill cutting of multiple nested tubulars" which claims priority to application No. 61/131,874, filed Jun. 14, 2008, entitled "Rotary milling casing cutter," which is hereby fully incorporated by reference.

FIELD OF THE INVENTION

The present disclosure generally relates to methods and apparatus for mill cutting through wellbore tubulars, including casing or similar structures.

BACKGROUND OF THE INVENTION

When oil and gas wells are no longer commercially viable, they must be abandoned in accord with government regulations. Abandonment requires that the installed tubulars, including all strings of tubing, pipe, casing or liners that comprise the multiple, nested tubulars of the well must be severed below the surface or the mud line and removed. Using explosive shape charges to sever multiple, nested tubulars in order to remove them has negative environmental impacts, and regulators worldwide are limiting the use of explosives. Therefore, a need exists for effective alternatives to the use of explosives for tubular severance in well abandonment.

Mechanical blade cutting and abrasive waterjet cutting have been implemented in response to new restrictive environmental regulations limiting the use of explosives.

Existing mechanical blade cutters utilized from the inside of the innermost casing, cutting out through each successive tubular of the multiple nested tubulars, requires multiple trips in and out of the wellbore. Such mechanical blade cutters require a rotary rig or some means of rotary drive in order to rotate the work string to which the mechanical blade cutter is attached. Rotary drive systems are both cumbersome and expensive to have at the work site. Existing mechanical blade cutters are deficient because, among other reasons, the mechanical blade cutters may break when they encounter non-concentric tubulars. Another deficiency is the limitation on the number of nested tubulars that may be severed by the mechanical blade cutter at one time or trip into the wellbore. An "inner" and "outer" string may be severable, if generally concentrically positioned in relation to each other. However, there is no current capability for severing a multiple non-concentrically (eccentrically) nested tubulars that provides consistent time and cost results in a single trip into the wellbore.

Most advances in the mechanical blade cutting art have focused on cut chip control and efficiency, rather than focusing on the fundamental issues of blade breakage and required, multiple, undesired trips of the apparatus in and out of a well. Thus these fundamental problems of existing mechanical blade cutting persist.

When cutting multiple, nested tubulars of significant diameters, for example 9 ⅝ inches outside diameter through 36 inches outside diameter, with at least two other nested tubulars of different sizes dispersed in between, the mechanical blade cutter must be brought back to the surface where successive larger cutting blades are exchanged for smaller cutting blades. Exchanging the smaller blades for larger blades allows the downhole cutting of successively larger diameter multiple, nested tubulars.

To access the downhole mechanical blade cutter, the user must pull the entire work string out of the wellbore and unscrew each work string joint until the mechanical blade cutter is removed from the bottom of the work string. After exchanging the mechanical blade cutter for a larger cutting blade, the work string joints are screwed back together, one after another, and tripped back into the wellbore. The mechanical blade cutter trip back into the wellbore to the previous tubular cut location for additional cutting is compromised because the length of the work string varies due to temperature changes or occasionally human error in marking or counting work string joints. Consequently, it is difficult to precisely align successive cuts with earlier cuts.

Many installed multiple, nested tubular strings in wells are non-concentric, meaning that the nested tubulars are positioned off center in relation to the innermost tubular. This is often the case because the outer tubulars do not have the same center diameter as the inner tubular. As a result of the multiple, nested tubulars being stacked or clustered to one side, i.e. non-concentric to each other, the density or amount of material being cut will vary circumferentially during cutting. Mechanical cutter blades sometimes experience breakage when cutting multiple, nested tubulars positioned non-concentrically in relation to each other. The blade cutter often breaks from the contact with the leading edge of a partial segment of the casing that remains after another segment of that casing has been cut away. The remaining portion of the casing forms a "C" or horseshoe-type shape when viewed from above. The blade cutter extends to its fullest open cut position after moving across a less dense material or open space (because that material has been cut away) and when the blade cutter impacts the leading edge of the "C" shaped tubular, the force may break off the blade. The breaking of a cutter blade requires again tripping out and then back into the well and starting over at a different location in the wellbore in order to attempt severing of the multiple, nested tubulars. Non-concentric, multiple, nested tubulars present serious difficulties for mechanical blade cutters. Severing non-concentric multiple, nested tubulars may take a period of days for mechanical blade cutters.

Existing abrasive waterjet cutters also experience difficulties and failures to make cuts through multiple, nested tubulars. Primarily, existing solutions relate to abrasive waterjet cutting utilizing rotational movement in a substantially horizontal plane to produce a circumferential cut in downhole tubulars. However, the prior art in abrasive waterjet cutters for casing severance often results in spiraling cuts with narrow kerfs in which the end point of the attempted circumferential cut fails to meet the beginning point of the cut after the cutting tool has made a full 360 degree turn. In other words, the cut does not maintain an accurate horizontal plane throughout the 360 degree turn, and complete severance fails to be achieved. Another problem encountered by existing abrasive waterjet cutting is the inability to cut all the way through the thicker, more widely spaced mass of non-concentrically positioned tubulars. In this situation, the cut fails to penetrate all the way through on a 360 degree circumferential turn. A further disadvantage of traditional abrasive waterjet cutting is that in order to successfully cut multiple, nested tubulars downhole, air must be pumped into the well bore to create an "air pocket" around the area where the cutting is to take place, such that the abrasive waterjet tool is not impeded by water or wellbore fluid. The presence of fluid in the cutting environment greatly limits the effectiveness of existing abrasive waterjet cutting.

Existing systems provide, verification of severance by welding "ears" on the outside of the top portion of the tubulars under the platform, attaching hydraulic lift cylinders, heavy lift beams, and then lifting the entire conductor (all tubulars) to verify complete detachment has been achieved. Basically, if the tubulars are able to be lifted from the well bore, it is assumed the severance was successful. When working offshore, this lifting verification process occurs before even more costly heavy lift boats are deployed to the site. This method of verification is both time-consuming and expensive.

There exist methods to mill windows via longitudinal, vertical travel in casing. However, these milling methods do not completely sever multiple, nested non-concentric tubulars for well abandonment. One such rotary milling method uses a whipstock, which must be deployed before the window milling process can begin. A rotary mill is then actuated against one side of a tubular along with a means of vertical travel, enabling a window to be cut through the tubular. However, this method does not permit 360 degree circumferential severance of multiple, nested tubulars and is not suited for the purpose of well abandonment.

This invention provides a safe and environmentally benign means of completely severing multiple, nested tubulars for well abandonment including overcoming the difficulties encountered by mechanical blade cutting, abrasive waterjet cutting or other means of tubular milling currently available.

BRIEF SUMMARY OF THE INVENTION

This invention provides methodology and apparatus for efficiently severing installed multiple, nested strings of tubulars, either concentric or eccentric, as well as cement or other material in the annuli between the tubulars, in a single trip into a well bore in an environmentally sensitive manner without the need for a rig.

The invention utilizes a computer-controlled robotic downhole rotary mill to effectively generate a shape(s) or profile(s) through, or completely sever in a 360 degree horizontal circumferential plane, the installed tubing, pipe, casing and liners as well as cement or other material that may be encountered in the annuli between the tubulars. This process occurs under programmable robotic, computerized control, making extensive use of digital sensor data to enable algorithmic, robotic actuation of the downhole assembly and robotic rotary mill cutter.

The downhole assembly is deployed inside the innermost tubular to a predetermined location and, under computer control, a rotary mill cuts outward radially and vertically, cutting a void (or swath) and completely severing the installed tubing, pipe, casing and liners as well as cement or other material that may be encountered in the annuli between the tubulars. The complete severance process occurs during one trip into the well bore.

Although this system is designed for precise W-axis movement in a 360 degree horizontal plane, due to the wide swath or void it generates when removing material in said horizontal plane, it does not require the exact alignment of the starting and ending points in the 360 degree cut that are otherwise required by traditional waterjet systems. Traditional narrow-kerf abrasive waterjet systems often create a "spiral" cut because of an inability to maintain perfect alignment from the starting point to the ending point. This "spiral" cut causes severance attempts to fail because the starting point of the cut and the ending point of the cut did not meet.

Additionally, by cutting a void (or swath) into the tubulars, the severed casing will drop vertically at the surface platform, providing visual verification of the severance. The reach of the cutter, is designed to extend beyond the outermost casing with any number of additional tubulars inside this outermost casing being extremely eccentrically positioned. This solves the cutting "reach" problems that are encountered with abrasive waterjet cutting when the waterjet has difficulty cutting through the thickest, most widely spaced mass of the eccentrically positioned tubulars and cement.

The programmable computer-controlled, sensor-actuated rotary milling process will take less time to complete severance than mechanical blade cutters or existing abrasive waterjet cutting. The actively adjusted rotary milling, profile generation process prevents the impact breakage that plagues mechanical blade cutters encountering non-concentric, multiple, nested tubulars. Furthermore, this invention's capability of being deployed and completing the severance in one trip downhole provides a significant advantage over prior art.

Therefore, a technical advantage of the disclosed subject matter is the complete severing of tubing, pipe, casing and liners, as well as cement or other material, that may be encountered in the annuli between the tubulars in a single trip down hole.

Another technical advantage of the disclosed subject matter is providing visual verification of severance without employing additional equipment.

Yet another technical advantage of the disclosed subject matter is creating a wide void (or swatch) thereby removing substantial material such that the start point and end point of the void (or swath) do not have to precisely align for complete severance.

An additional technical advantage of the disclosed subject matter is avoiding repeat trips down hole because of cutter breakage.

Another technical advantage of the disclosed subject matter is efficiently severing non-concentrically (eccentrically) aligned nested tubulars.

Yet another technical advantage of the disclosed subject matter is accomplishing severance in less time and in an environmentally benign manner.

Still another technical advantage is providing electronic feedback showing cutter position and severance progress.

These and other features and advantages will be readily apparent to those with skill in the art in conjunction with this disclosure.

BRIEF DESCRIPTION OF THE DRAWINGS

The features, nature, and advantages of the disclosed subject matter will become more apparent from the detailed description set forth below when taken in conjunction with the accompanying drawings.

DETAILED DESCRIPTION OF THE INVENTION

Figure 1:
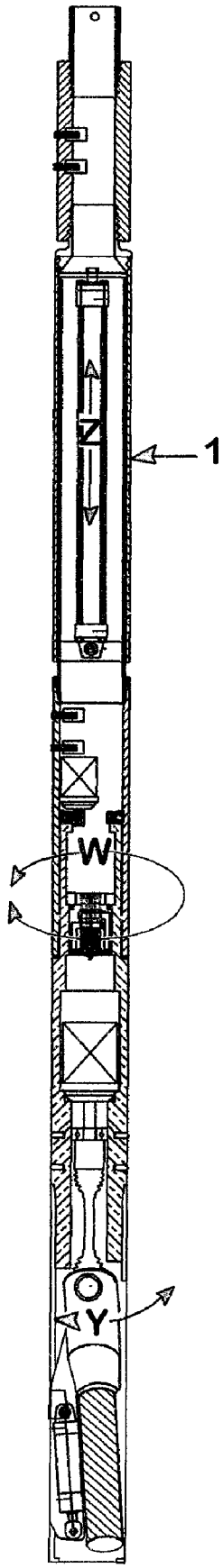
FIG. 1 depicts the robotic rotary mill cutter of the preferred embodiment.

Although described with reference to specific embodiments, one skilled in the art could apply the principles discussed herein to other areas and/or embodiments.

Throughout this disclosure casing(s) and tubular(s) are used interchangeably.

This invention provides a method and apparatus for efficiently severing installed tubing, pipe, casing, and liners, as well as cement or other encountered material in the annuli between the tubulars, in one trip into a well bore.

Reference will now be made in detail to the present embodiments of the disclosure, examples of which are illustrated in the accompanying drawings. Wherever possible, the same reference numbers will be used throughout the drawings to refer to the same or like parts (elements).

To help understand the advantages of this disclosure the accompanying drawings will be described with additional specificity and detail.

The method generally is comprised of the steps of positioning a robotic rotary mill cutter inside the innermost tubular in a pre-selected tubular or plurality of multiple, nested tubulars to be cut, simultaneously moving the rotary mill cutter in a predetermined programmed vertical X-axis, and also 360 degree horizontal rotary W-axis, as well as the spindle swing arm in a pivotal Y-axis arc.

In one embodiment of the present disclosure the vertical and horizontal movement pattern(s) and the spindle swing arm are capable of being performed independently of each other, or programmed and operated simultaneously in conjunction with each other. The robotic rotary mill cutter is directed and coordinated such that the predetermined pattern is cut through the innermost tubular beginning on the surface of said tubular with the cut proceeding through it to form a shape or window profile(s), or to cut through all installed multiple, nested tubulars into the formation beyond the outermost tubular.

A profile generation system simultaneously moves the robotic rotary mill cutter in a vertical Z-axis, and a 360-degree horizontal rotary W-axis, and the milling spindle swing arm in a pivotal Y-axis arc to allow cutting the tubulars, cement, and formation rock in any programmed shape or window profile(s).

The robotic rotary mill cutter apparatus is programmable to simultaneously or independently provide vertical X-axis movement, 360 degree horizontal rotary W-axis movement, and spindle swing arm pivotal Y-axis arc movement under computer control. A computer having a memory and operating pursuant to attendant software, stores shape or window profile(s) templates for cutting and is also capable of accepting inputs via a graphical user interface, thereby providing a system to program new shape or window profile(s) based on user criteria. The memory of the computer can be one or more of but not limited to RAM memory, flash memory, ROM memory, EPROM memory, EEPROM memory, registers, hard disk, a removable disk, a CD-ROM, floppy disk, DVD-R, CD-R disk or any other form of storage medium known in the art. In the alternative, the storage medium may be integral to the processor. The processor and the storage medium may reside in an ASIC or microchip.

The computer controls the profile generation servo drive systems as well as the milling cutter speed. The robotic rotary mill cutter requires load data to be able to adjust for conditions that cannot be seen by the operator. The computer receives information from torque sensors (see 52, and 53 of FIGS. 2A and 2B) attached to Z-axis, W-axis, Y-axis, and milling spindle drive motor, and makes immediate adaptive adjustments to the feed rate and speed of the vertical Z-axis, the 360 degree horizontal rotary W-axis, the spindle swing arm pivotal Y-axis and the RPM of the milling spindle motor.

Software in communication with sub-programs gathering information from the torque devices, such as a GSE model Bi-Axial transducer Model 6015 or a PCB model 208-M133, directs the computer, which in turns communicates with and monitors the downhole robotic rotary mill cutter and its attendant components, and provides feeds and speeds simultaneously or independently along the vertical Z-axis, the 360 degree horizontal rotary W-axis, as well as the pivotal spindle swing arm Y-axis arc movement.

The shape or window profile(s) are programmed by the operator on a program logic controller (PLC), personal computer (PC), or a computer system designed or adapted for this specific use. The integrated software via a graphical user interface (GUI) or touch screen, such as a Red Lion G3 Series (HMIs), accepts inputs from the operator and provides the working parameters and environment by which the computer directs and monitors the robotic rotary mill cutter.

In the preferred embodiment, the vertical Z-axis longitudinal computer-controlled servo axis uses a hydraulic cylinder, such as the Parker Series 2HX hydraulic cylinder, housing the MTS model M-series absolute analog sensor for ease of vertical Z-axis longitudinal movements, although other methods may be employed to provide up and down vertical movement of the robotic rotary mill cutter.

In a still further embodiment of the present disclosure the vertical Z-axis longitudinal computer-controlled servo axis may be moved with a ball screw and either a hydraulic or electric motor, such as a computer controlled electric servo axis motor, the Fanuc D2100/150 servo, with encoder feedback to the computer system by an encoder (see 50 in FIG. 2A) such as the BEI model H25D series incremental optical encoder. Servo motors and ball screws are known in the art and are widely available from many sources.

In a still further embodiment of the present disclosure, the vertical Z-axis longitudinal computer-controlled servo axis may be moved with a rack and pinion, either electrically or hydraulically driven. Rack and pinion drives are are known in the art and are widely available from many sources.

In the preferred embodiment, the rotational computer controlled W-axis rotational movement is an electric servo motor, although other methods may be employed. The rotational computer-controlled W-axis servo motor, such as a Fanuc model D2100/150 servo, provides 360-degree horizontal rotational movement of the robotic rotary mill cutter through a specially manufactured slewing gear.

Also in the preferred embodiment, the Y-axis pivotal milling spindle swing arm computer-controlled servo axis uses a hydraulic cylinder for ease of use, although other methods may be employed. The Y-axis pivotal milling spindle swing arm computer-controlled servo axis, may utilize the Parker Series 2HX hydraulic cylinder, housing the MTS model M-series absolute analog sensor (see 51 in FIG. 2B) inside the hydraulic cylinder to provide position feedback to the computer controller for pivotal spindle swing arm Y-axis arc movement.

In a still further embodiment of the present disclosure an inertia reference system such as, Clymer Technologies model Terrella6 v2, can provide information that the robotic rotary mill cutter is actually performing the movements sent by the computer controller as a verification reference. If the reference shows a sudden stop, the computer can go into a hold action stopping the robotic rotary mill cutter and requiring operator intervention before resuming milling operations.

The methods and systems described herein are not limited to specific sizes, shapes, or models. Numerous objects and advantages of the disclosure will become apparent as the following detailed description of the multiple embodiments of the apparatus and methods of the present disclosure are depicted in conjunction with the drawings and examples, which illustrate such embodiments.

FIG. 1 depicts the robotic rotary mill cutter 1. The robotic rotary mill cutter 1, shows the position of the vertical Z-axis, and the 360-degree horizontal rotary W-axis, and the milling spindle swing arm pivotal Y-axis.

Figure 2A:
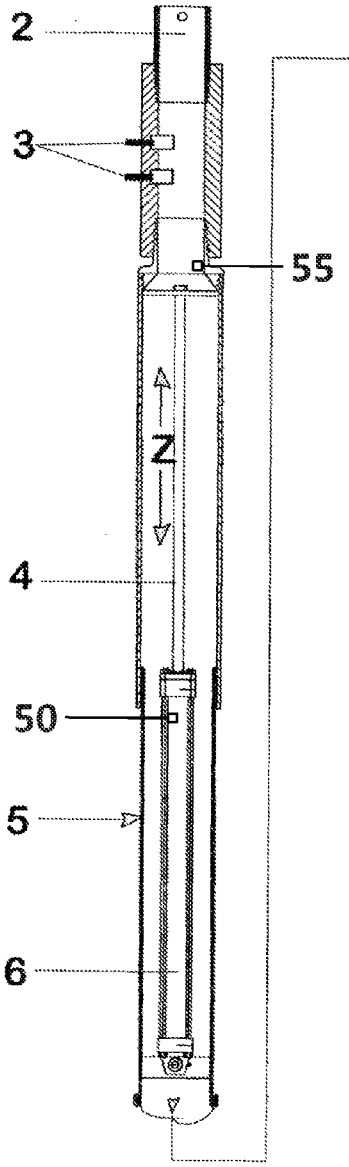
FIGS. 2A and 2B, depict the upper and lower portions, respectively, of the robotic rotary mill cutter of the preferred embodiment.
Figure 2B:
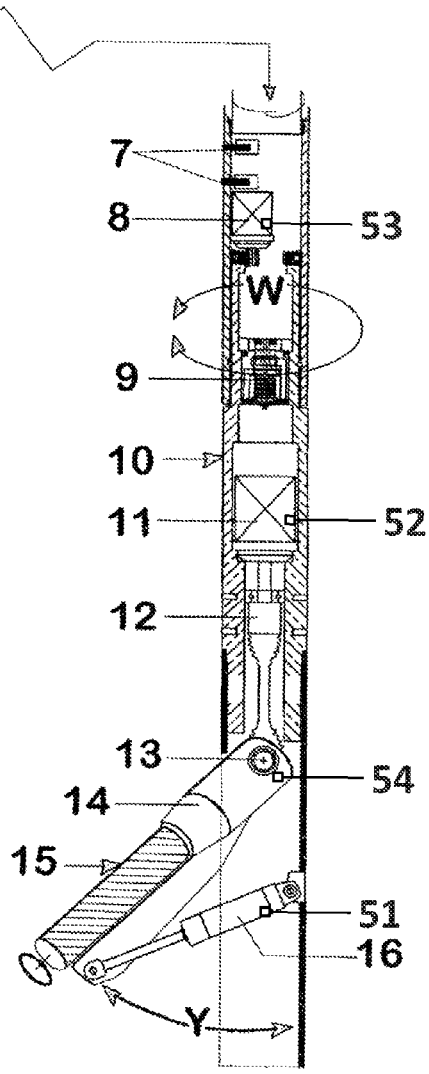

FIGS. 2A and 2B, depict the upper and lower portions, respectively, of the robotic rotary mill cutter of the preferred embodiment.

Referring to FIG. 2A, a collar 2 is used to attach the umbilical cord (not shown) and cable (not shown) to the body of robotic rotary mill cutter 1. Collar 2 may be exchanged to adapt to different size work strings (not shown). Additionally, the collar 2 provides a quick disconnect point in case emergency removal of the robotic rotary mill cutter 1 is necessary. After the robotic rotary mill cutter 1 is in the cut location, locking hydraulic cylinders 3 are energized to lock the robotic rotary mill cutter 1 into the well bore (not shown). In the preferred embodiment, after the locking hydraulic cylinders 3 have been energized, Z-axis hydraulic cylinder 6 is moved to a down position by extending piston rod 4 allowing the Z-axis slide 5 to extend. This permits the robotic rotary mill cutter 1 to begin cutting at the lowest point of the cut and be raised as needed to complete the severance.

Referring to FIG. 2B, additional locking hydraulic cylinders 7 are available should additional stabilization (if energized) or movement (if not energized) are desired. W-axis servo motor 8 rotates the W-axis rotating body 10 under control of the computer (not shown). W-axis rotating body 10 houses the milling spindle swing arm 14 and the milling spindle swing arm 14 is driven by motor 11 also housed in the W-axis rotating body 10. Milling spindle swing arm 14 is driven by motor 11 through a half-shaft 12 such as Motorcraft model 6L2Z-3A427-AA.

Half-shaft 12 has a C.V. joint (not shown) that allows milling spindle swing arm 14 to pivot in an arc from pivot bearing 13 that goes through W-axis rotating body 10. Milling spindle swing arm 14 is moved by Y-axis hydraulic cylinder 16. The rotation of W-axis rotating body 10 requires a swivel joint 9, such as Rotary Systems Model DOXX Completion, to allow power and sense lines (not shown) to motor 11, Y-axis hydraulic cylinder 16, and load cell 54 sense wires (not shown). Cutting device 15 (for example, a carbide cutter) is mounted to the milling spindle swing arm 14 and is moved by Y-axis hydraulic cylinder 16 into the cut under computer control.

Figure 3:
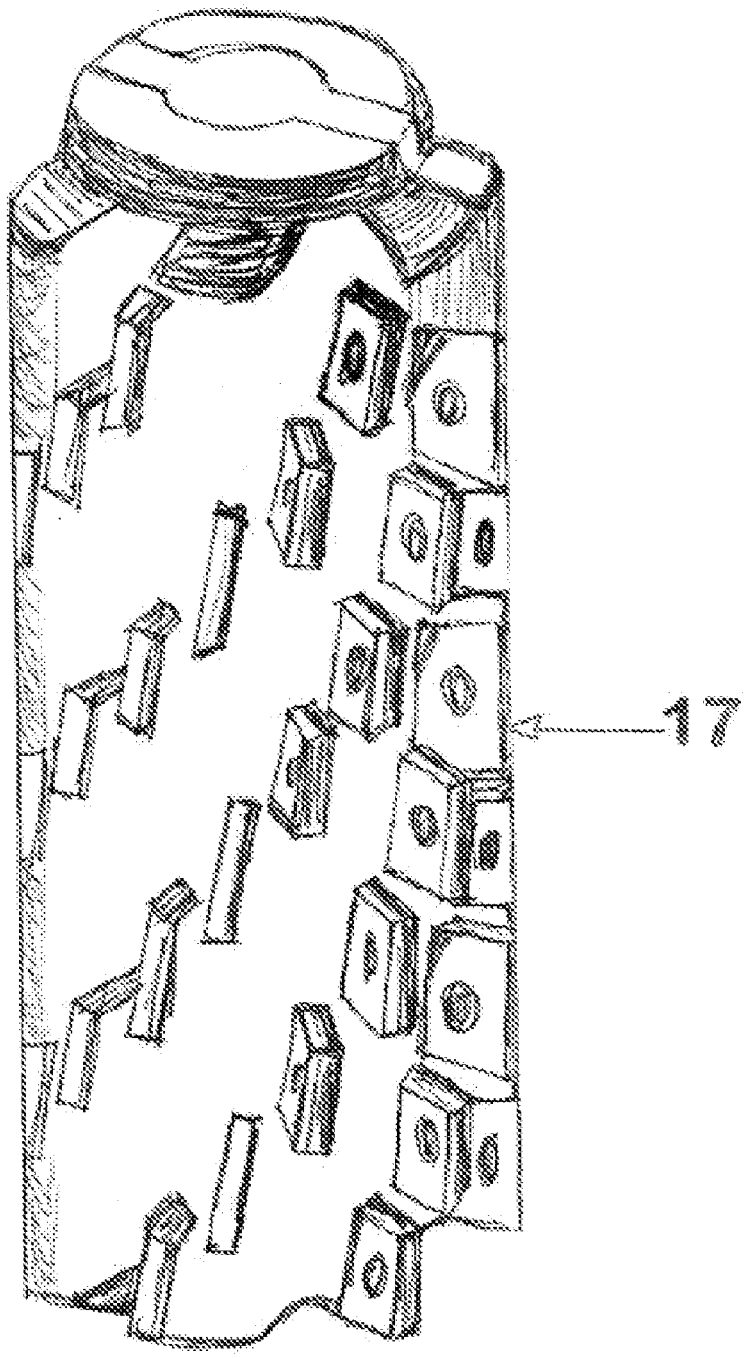
FIG. 3 depicts an expanded view of an inserted carbide mill of one embodiment.

FIG. 3 depicts an expanded view of one embodiment of an inserted carbide mill 17 that could be attached to milling spindle swing arm 14. Other milling units with different material and/or cutting orientation could be utilized depending on the particular characteristics of the severance to be performed.

Figure 4A:
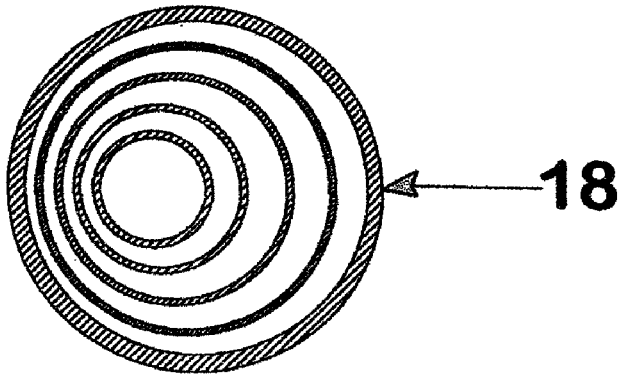
FIG. 4A depicts a top view of multiple casings (tubulars) that are non-concentric.

FIG. 4A depicts a top view of nested multiple casings (tubulars) 18 that are positioned non-concentrically.

Figure 4B:
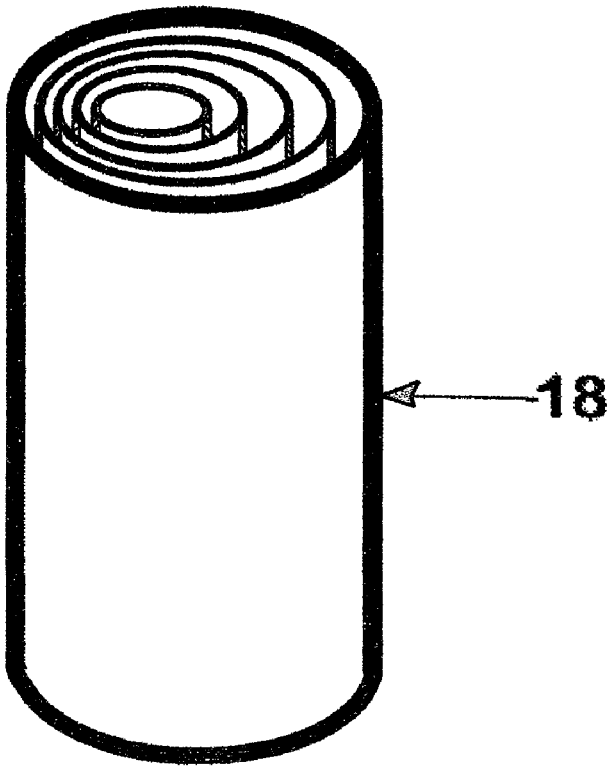
FIG. 4B depicts an isometric view of non-concentric casings (tubulars).

FIG. 4B depicts an isometric view of nested multiple casings (tubulars) 18 that are positioned non-concentrically.

Figure 5A:
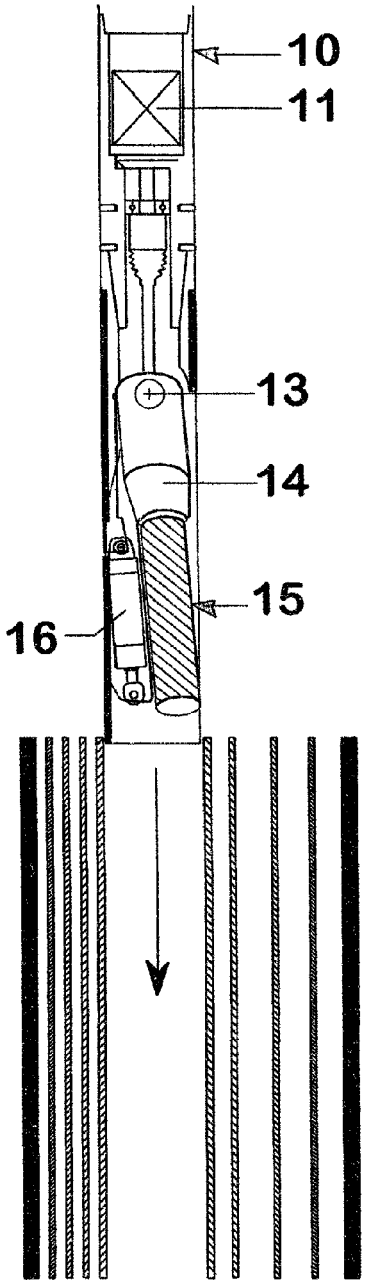
FIG. 5A depicts a portion of the robotic rotary mill cutter as it enters the tubulars.

FIG. 5A depicts a portion of the robotic rotary mill cutter 1 as it enters the nested multiple casings (tubulars) 18.

Figure 5B:
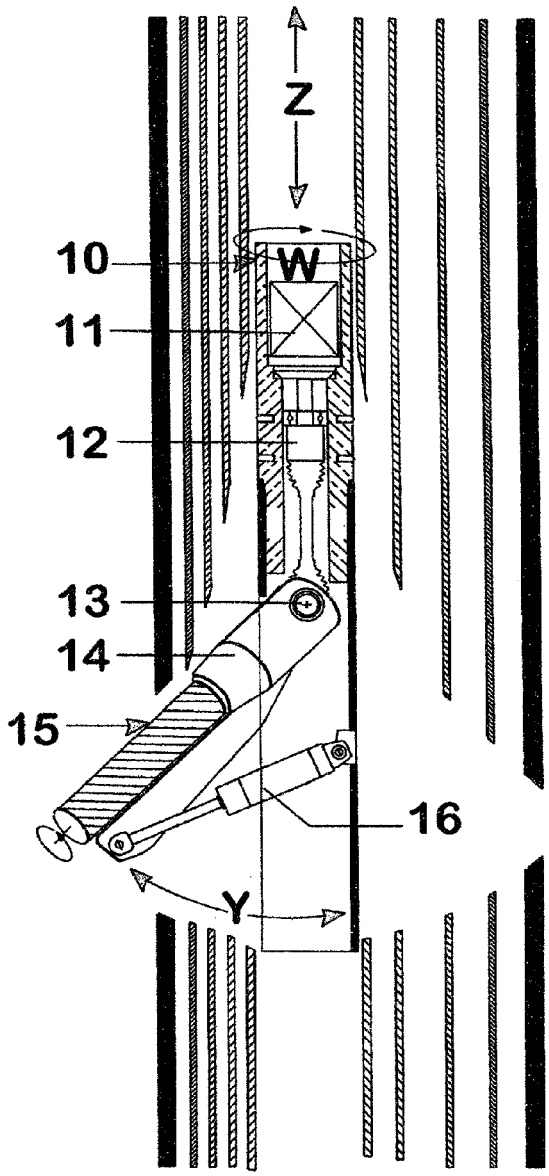
FIG. 5B depicts a portion of the robotic rotary mill cutter as it is severing multiple casings.

FIG. 5B shows the nested multiple casings (tubulars) 18 with the void that has been created by the robotic rotary mill cutter 1. The profile generation system (not shown) simultaneously moved the robotic rotary mill cutter 1 in a vertical Z-axis, and a 360-degree horizontal rotary W-axis, and the milling spindle swing arm 14 in a pivotal Y-axis arc to allow cutting of the tubulars, cement (not shown), and formation rock (not shown) in any programmed shape or window profile(s) thereby cutting through the multiple casing (tubulars) 18, cement (not shown) or other encountered material in casing annuli (not shown).

The disclosed subject matter covers the scope of functionality in a holistic way. Although described with reference to particular embodiments, those skilled in the art, with this disclosure, will be able to apply the teachings in principles in other ways. All such additional embodiments are considered part of this disclosure and any claims to be filed in the future.

We claim:

1. An apparatus for cutting through at least two tubulars, the apparatus comprising:

a control device;

a robotic rotary mill cutter, said robotic rotary mill cutter comprising:

a Z-axis movement device associated with said robotic rotary mill cutter, said Z-axis movement device raising or lowering a cutting device in a Z-axis in response to a signal from said control device, said Z-axis generally in the longitudinal direction of the tubulars;

a W-axis motor associated with said Z-axis movement device;

a W-axis rotating body rotatably coupled to said W-axis motor, said W-axis motor rotating said W-axis rotating body in a W-axis in response to a signal from said control device, said W-axis of rotation rotating about said Z-axis;

a Y-axis extension device coupled between a milling spindle swing arm and said W-axis rotating body, said Y-axis extension device hydraulically pivoting said milling spindle swing arm towards or from said W-axis rotating body in response to a signal from said control device, said milling spindle swing arm capable of pivoting said cutting device beyond said tubulars;

a motor rotatably coupled to said cutting device, said cutting device associated with said milling spindle swing arm, said motor rotating said cutting device in response to a signal from said control device, said cutting device capable of cutting a horizontal distance greater than the length of said cutting device; and said W-axis motor capable of rotating said W-axis rotating body simultaneously with said cutting device cutting said tubular.

2. The apparatus according to claim 1, wherein said robotic rotary mill cutter is riglessly deployable.

3. The apparatus according to claim 1, wherein said control device is a general purpose computer.

4. The apparatus according to claim 1, additionally comprising more than one tubulars, said tubulars nested within one another and eccentrically aligned to one another.

5. The apparatus according to claim 4, wherein said tubulars are comprised of one or more metal or composite material.

6. The apparatus according to claim 4, wherein said robotic rotary mill is adapted to be received into the innermost of said tubulars, said innermost tubular having a minimum inside diameter of five inches.

7. The apparatus according to claim 1, additionally comprising a swivel coupling disposed between said motor and said cutting device.

8. The apparatus according to claim 7, wherein said swivel coupling is a constant velocity joint.

9. The apparatus according to claim 1, wherein said cutting device is comprised of one or more of:

ceramic;

silicon carbide;

tungsten carbide;

high speed steel; and diamonds.

10. The apparatus according to claim 1, additionally comprising at least one locking device associated with said robotic rotary mill cutter, said locking device either locking or releasing said robotic rotary mill cutter's position within at least one tubular in response to a signal from said control device.

11. The apparatus according to claim 10, wherein said locking device is one or more of a cylinder or a packer.

12. The apparatus according to claim 1, said signals delivered via an umbilical cord or cable.

13. The apparatus according to claim 12, said umbilical cord or cable additionally comprising a quick disconnect, said quick disconnect separating said control device from either said robotic rotary mill or said umbilical cord or cable.

14. The apparatus according to claim 1, wherein said Z-axis movement device is disposed within said robotic rotary mill cutter and extends or contracts said robotic rotary mill.

15. The apparatus according to claim 14, wherein said Z-axis movement device is either electrically or hydraulically driven via a ball screw, cylinder, or rack and pinion.

16. The apparatus according to claim 1, additionally comprising a positional data sensor.

17. The apparatus according to claim 16, wherein said positional data sensor is an inertia reference system.

18. The apparatus according to claim 1, wherein an encoder supplies at least one of Z-axis position data and W-axis position data to said control device.

19. The apparatus according to claim 1, wherein a load cell supplies at least one of Z-axis forces and W-axis forces to said control device.

20. The apparatus according to claim 1, additionally comprising an encoder associated with said motor, said encoder supplying RPM data to said control device.

21. The apparatus according to claim 1, additionally comprising a position device associated with said Y-axis extension device, said position device supplying position data to said control device.

22. The apparatus according to claim 21, wherein said position device is an inductive positioning system.

23. The apparatus according to claim 21, additionally comprising a load cell associated with said Y-axis extension device, said load cell supplying force data to said control device.

24. A method for cutting through at least two tubulars, the method comprising the steps of:

lowering a robotic rotary mill into a tubular along a Z-axis, said Z-axis generally in the longitudinal direction of said tubular;

starting a motor, said motor rotationally coupled to a cutting device;

pivoting said cutting device away from said robotic rotary mill such that said cutting device impacts said tubular, said cutting device capable of cutting a horizontal distance greater than the length of said cutting device;

rotating said cutting device about said Z-axis simultaneously with said cutting device cutting said tubular;

raising or lowering said cutting device in said tubular; and maintaining contact between said cutting device and said tubular until said cutting device has:

severed a pre-determined number of said tubulars;

cut for a pre-determined length of time;

cut a pre-determined distance, shape, or profile; or severed all said tubulars.

25. The method of claim 24, wherein said tubular of said lowering step is an innermost tubular of the tubulars.

26. The method of claim 24, with the additional step of locking said robotic rotary mill within said tubular.

27. The method of claim 24, said step of raising or lowering accomplished by expanding or contracting said robotic rotary mill in the Z-axis.

28. The method of claim 24, with the additional steps of:

monitoring said cutting device's Z-axis position within said tubulars; and adjusting said cutting device's Z-axis location in response to said monitoring.

29. The method of claim 24, with the additional steps of:

monitoring said cutting device's W-axis position within said tubulars, said W-axis of rotation rotating about said Z-axis; and adjusting said cutting device's W-axis location in response to said monitoring.

30. The method of claim 24, with the additional steps of:

monitoring the force applied to said cutting device as said cutting device impacts said tubulars; and adjusting said pivoting in response to said monitoring.

31. The method of claim 24, with the additional steps of:

monitoring the rotational speed of said cutting device; and adjusting said motor in response to said monitoring.

32. The method of claim 24, with the additional step of verifying the result of said maintaining contact step.

33. The method of claim 24, said tubulars eccentrically aligned.

34. The method of claim 24, said method riglessly deployable.

35. A cutting tool for cutting a tubular having a tubular bore, the tubular being capable of being disposed in a well bore, comprising:

(a) a tool body configured to be lowered into the tubular bore, the tool body having a longitudinal Z-axis, a W-axis of rotation rotating about said Z-axis, and an anchoring system attached to the tool body, the anchoring system having engaged and non-engaged conditions, wherein during the engaged condition the tool body is anchored relative to the tubular, and during the non-engaged position the tool body is not anchored relative to the tubular;

(b) the tool body including a cutting head movably connected to the tool body in both the Z and W axes, the tool body supporting a drive system that includes a first motor drive and a second motor drive;

(c) the cutting head being coupled to the first motor drive, wherein the first motor drive causing the cutting head to be moved in the W-axis of rotation relative to the tool body;

(d) the cutting head being coupled to the second motor drive, wherein the second motor drive causing the cutting head to be moved in the Z-axis relative to the tool body;

(e) the cutting head including: a spindle housing pivotally connected to the cutting head at a pivot, the pivot being located at a first elevation, the spindle housing having: (i) an elongated cutting member with distal and proximal ends, and the elongated cutting member being rotationally connected to the spindle housing, the elongated cutting member having a longitudinal axis spanning between its first and second ends, (ii) the spindle housing having a first lower distal end portion and second upper proximal end portion, the upper proximal end portion being connected to the cutting head at the pivot, the spindle housing and elongated cutting member being able to travel through an arcuate path having first and second extreme arcuate positions, wherein the first extreme arcuate position is more closely aligned with the Z-axis compared to the second extreme arcuate position, and the second extreme arcuate position is more closely aligned with the W-axis compared to the first extreme arcuate position;

(f) an arcuate actuator operatively connected to the spindle housing, the actuator having actuator first and second end portions, the first end portion being mounted to the cutting head at an elevational position which is below the first elevation, and at the other of its end portions being mounted to the spindle housing at a position also below the first elevation, the actuator moving the spindle housing and elongated cutting member between first and second extreme arcuate positions; and (g) a third motor drive operably connected to the elongated cutting member causing the elongated cutting member to rotate about the elongated cutting member's longitudinal axis and relative to the spindle housing.

36. The cutting tool of claim 35, wherein the spindle housing includes a support that extends along the length of the elongated cutting member and that supports the elongated cutting member, wherein the actuator attaches to the support.

37. The cutting tool of claim 35, wherein the elongated cutting member has an outer surface and a plurality of cutting blades on the outer surface the plurality of cutting blades arranged in a plurality of helixes about the outer surface.

38. The cutting tool of claim 35, wherein pivoting the spindle housing moves the elongated cutting member into a cutting position that cuts the tubular initially with the distal end portion of the cutting member and then with the proximal end portion of the cutting member.

39. The cutting tool of claim 35, wherein the actuator is fluid driven.

40. The cutting tool of claim 39, wherein the actuator is a hydraulic cylinder.

41. The cutting tool of claim 35, wherein the elongated cutting member, actuator, and tool body form a triangle below the pivot bearing.

42. The cutting tool of claim 35, wherein the pivot bearing, the attachment of the actuator to the tool body and the attachment of the actuator to the spindle housing form the vertices of a triangle that extends below the pivot bearing.

43. The cutting tool of claim 35, wherein there are a plurality of nested tubulars including an innermost tubular and the tool body is configured to be lowered into the tubular bore of the innermost tubular.

44. The cutting tool of claim 43, wherein the elongated cutting member cuts into each of the nested tubulars when the spindle housing and elongated cutting member are rotated about the pivot, wherein the distal end of the elongated cutting member cuts the innermost tubular member at a first, higher elevation and the distal end of the cutting member cuts an outer tubular member at a second, lower elevation.

45. A cutting tool for severing a plurality of nested tubulars, each tubular having a tubular bore, the nested tubulars being disposed in a well bore and wherein there is an outer tubular and an inner tubular inside the bore of the outer tubular, comprising:

(a) tool body configured to be lowered into the tubular bore, the tool body having a longitudinal Z-axis, a W-axis of rotation rotating about the Z-axis, and an anchoring system attached to the tool body, the anchoring system having engaged and non-engaged conditions, wherein during the engaged condition the tool body is anchored relative to the tubular, and during the non-engaged position the tool body is not anchored relative to the tubular;

(b) the tool body including a cutting head movably connected to the tool body in both the Z and W axes, the tool body supporting a drive system that includes a first motor drive and a second motor drive;

(c) the cutting head being coupled to the first motor drive, wherein the first motor drive causing the cutting head to be moved in the W-axis of rotation relative to the tool body;

(d) the cutting head being coupled to the second motor drive, wherein the second motor drive causing the cutting head to be moved in the Z-axis relative to the tool body;

(e) a cutting head coupled to the drive system at a pivot point, wherein the cutting head can travel through an arcuate path wherein the upper and lower sections are not generally aligned;

(f) the cutting head including an elongated cutting member having a first lower distal end portion and second upper proximal end portions;

(g) an actuator mounted at one of its end portions to the second end of the cutting head and at the other of its end portions to the tool body at a position spaced below the pivot point, the actuator powering the cutting member to rotate about the pivot bearing through an arc a sufficient amount of rotation to cut both the inner and the outer tubular; and (f) a third motor drive that rotates the elongated cutting member.

46. The cutting tool of claim 45, wherein there are three or more nested tubulars and the cutting member is configured to simultaneously cut each of the nested tubulars as it is rotated about the pivot bearing.

47. The cutting tool of claim 45, wherein the cutting head includes a support that extends along the length of the cutting member and that supports the cutting member, wherein the actuator attaches to the support.

48. The cutting tool of claim 45, wherein the cutting member has an outer surface with a plurality of cutting blades on the outer surface.

49. The cutting tool of claim 45, wherein rotation of the cutting head about the pivot moves the cutting member into a cutting position that cuts the tubular initially with the distal end portion of the cutting member and then with the proximal end portion of the cutting member.

50. The cutting tool of claim 45, wherein first motor drive is positioned above the pivot.

51. The cutting tool of claim 45, wherein second motor drive is positioned above the pivot.

52. The cutting tool of claim 45, wherein the cutting member, actuator and tool body form a triangle below the pivot bearing.

53. The cutting tool of claim 45, wherein the pivot bearing, the attachment of the actuator to the tool body and the attachment of the actuator to the cutting head form the vertices of a triangle that extends below the pivot.

54. The cutting tool of claim 45, wherein the cutting member cuts into each of the nested tubulars when the cutting member is rotated about the pivot, wherein the distal end of the cutting member cuts the innermost tubular member at a first, higher elevation and the distal end of the cutting member cuts an outer tubular member at a second, lower elevation.

55. A method of severing a plurality of nested tubulars, each tubular having a tubular bore, the nested tubulars being disposed in a well bore and wherein there is an outer tubular and an inner tubular inside the bore of the outer tubular, the method comprising the steps of:

(a) providing a cutting tool, the cutting tool including:

(i) a tool body configured to be lowered into the tubular bore of the innermost nested tubular, the tool body having a longitudinal Z-axis, a W-axis of rotation rotating about the Z-axis, and an anchoring system attached to the tool body, the anchoring system having engaged and non-engaged conditions, wherein during the engaged condition the tool body is anchored relative to the tubular, and during the non-engaged position the tool body is not anchored relative to the tubular;

(ii) the tool body including a cutting head movably connected to the tool body in both the Z and W axes, the tool body supporting a drive system that includes a first motor drive and a second motor drive;

(iii) the cutting head being coupled to the first motor drive, wherein the first motor drive causing the cutting head to be moved in the W-axis of rotation relative to the tool body;

(iv) the cutting head being coupled to the second motor drive, wherein the second motor drive causing the cutting head to be moved in the Z-axis relative to the tool body;

(v) the cutting head including: a spindle housing pivotally connected to the cutting head at a pivot, the pivot being located at a first elevation, the spindle housing having: (1) an elongated cutting member with distal and proximal ends, and the elongated cutting member being rotationally connected to the spindle housing, the elongated cutting member having a longitudinal axis spanning between its first and second ends, (2) the spindle housing having a first lower distal end portion and second upper proximal end portion, the upper proximal end portion being connected to the cutting head at the pivot, the spindle housing and elongated cutting member being able to travel through an arcuate path having first and second extreme arcuate positions, wherein the first extreme arcuate position is more closely aligned with the Z-axis compared to the second extreme arcuate position, and the second extreme arcuate position is more closely aligned with the W-axis compared to the first extreme arcuate position;

(vi) an arcuate actuator operatively connected to the spindle housing, the actuator having actuator first and second end portions, the first end portion being mounted to the cutting head at an elevational position which is below the first elevation, and at the other of its end portions being mounted to the spindle housing at a position also below the first elevation, the actuator moving the spindle housing and elongated cutting member between first and second extreme arcuate positions;

(vii) a third motor drive operably connected to the elongated cutting member causing the elongated cutting member to rotate about the elongated cutting member's longitudinal axis and relative to the spindle housing;

(b) from a surface location lowering the cutting tool into an innermost tubular of a plurality of nested tubulars;

(c) the third drive motor causing the elongated cutting member to rotate about the rotational cutting axis;

(d) the actuator causing the rotational cutting axis to move between the first and second extreme arcuate angles;

(e) the second drive motor rotating the cutting head in the W-axis;

(f) after step "b" and before step "g" the third drive motor moving the cutting head in the Z axis; and (g) before raising the tool body to the surface location, completely severing the plurality of the nested tubulars with the elongated cutting head.

56. The method of claim 55, wherein steps "c" and "e" are performed simultaneously.

57. The method of claim 56, wherein during step "e" at least a 360 degree rotation is performed.

58. The method of claim 55, wherein in step "a" the first extreme arcuate position is not aligned with the Z-axis.

59. The method of claim 55, wherein steps "e" and "f" are performed simultaneously.

60. The method of claim 55, wherein in step "b" the nested tubulars are eccentric with respect to each other.

61. The method of claim 55, wherein during step "c" a signal is received from a torque sensor operatively connected to the elongated cutting member, and adaptive adjustments are made causing the elongated cutting member to change from a first rotational speed to a second rotational speed.

62. The method of claim 55, wherein during step "d" a signal is received from a torque sensor operatively connected to the elongated cutting member, and adaptive adjustments are made causing the elongated cutting member to change from a first arcuate feed rate to a second arcuate feed rate.

63. The method of claim 55, wherein during step "e" a signal is received from a torque sensor operatively connected to the elongated cutting head, and adaptive adjustments are made causing the elongated cutting head to change from a first feed rate in the W-axis speed to a second feed rate in the W-axis.

* * * * *